United States Patent [19]

Sanders et al.

[11] 4,375,730

[45] Mar. 8, 1983

[54] REFLECTIVE INFORMATION DISPLAY DEVICE

[75] Inventors: Carlos L. Sanders, Atlanta; James L. Gebhardt, Roswell; Ferris L. Hutchins, Doraville, all of Ga.

[73] Assignee: The Mead Corporation, Dayton, Ohio

[21] Appl. No.: 308,012

[22] Filed: Oct. 5, 1981

[51] Int. Cl.[3] ..... G09F 11/18

[52] U.S. Cl. ..... 40/518; 40/5

[58] Field of Search ..... 40/5, 518, 564, 10 R

[56] References Cited

U.S. PATENT DOCUMENTS 3,513,577 5/1970 Kleinman ..... 40/518
3,703,779 11/1972 Goldman ..... 40/564 X
3,939,584 2/1976 Trame ..... 40/518
4,258,490 3/1981 Trame ..... 40/518

*Primary Examiner*—Gene Mancene
*Assistant Examiner*—Wenceslao J. Contreras
*Attorney, Agent, or Firm*—Erwin Doerr

[57] ABSTRACT

A display device such as is used to display automobile service station price data in which a support surface (26) provides a display area (22,23,24,25) and an adjustable information strip (39) is slideable across the support face to present different information characters (40) in the display area and a reflective surface carried by the support face to reflect light through either translucent characters on opaque background areas of the strip or through translucent background areas of the strip having opaque characters.

14 Claims, 3 Drawing Figures

REFLECTIVE INFORMATION DISPLAY DEVICE

Display devices for presenting information such as those used for automobile service station price display signs, scoreboards for athletic events and pricing/brand name displays in supermarkets and other similar retail outlets are known to include a source of internal illumination to present the information displayed more clearly.

In some of these devices the information presented is carried by an adjustable carrier strip so that the displayed information can be altered readily. In other of these devices when the displayed information is not readily changeable it is known to dispense with the power source of illumination by providing a reflective surface behind the information presented so as to enhance the display. However, in both these types of device the construction has tended to be complicated and expensive.

One aspect of this invention utilizes the advantage achieved in providing a readily adjustable information display together with the advantage secured by enhancing the display without the need for a powered source of illumination while at the same time using relatively inexpensive materials.

This aspect of the invention provides a display device comprising a support surface defining at least in part a display area, an adjustable information strip having thereon a series of areas defined by characters and a series of surrounding areas bounding the characters wherein one of the said series of areas is translucent, the strip being mounted for slideable movement relative to the support surface so that said characters can be sequentially presented in the display area, and a light reflective surface disposed behind the strip in the display area whereby light impinging on said reflective surface is transmitted through the translucent area of the strip present in the display area.

Another aspect of this invention utilizes the advantage achieved in providing an internally illuminated readily adjustable information display whilst at the same time producing a lightweight compact structure fabricated from relatively inexpensive materials.

For a better understanding of the invention reference is made to the following detailed description taken in conjunction with the accompanying drawings in which.

Figure 1:
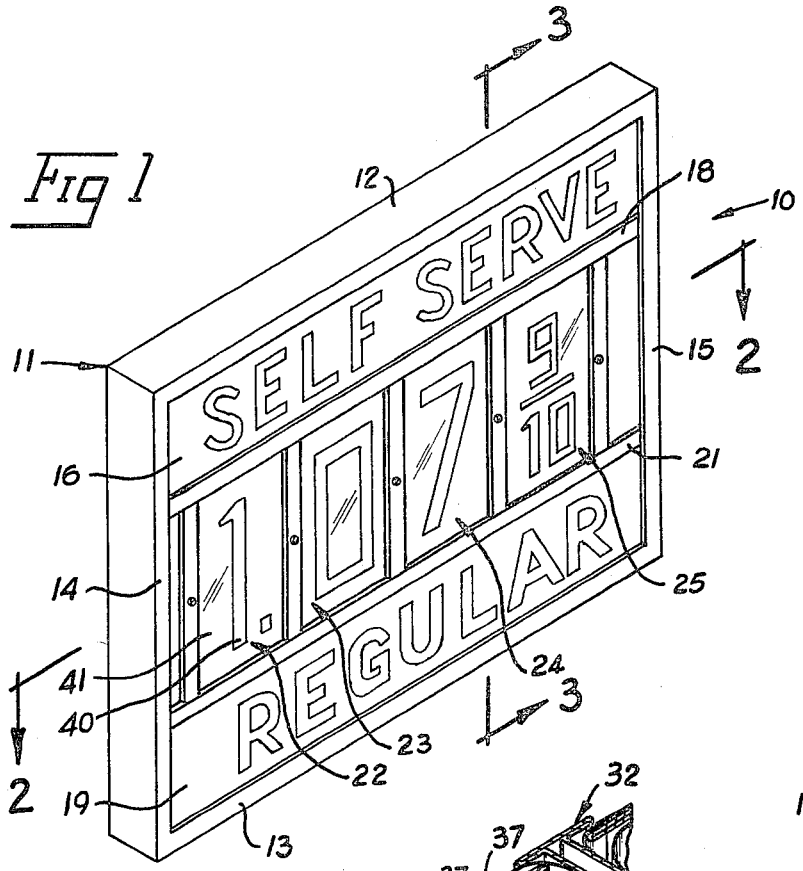
FIG. 1 is an isometric view of an automobile service station price indicating sign constructed according to the invention.

Referring first to FIG. 1, an automobile service station price sign 10 comprises a generally rectangular frame 11 comprising upper and lower channel section borders 12, 13 respectively and channel section end borders 14, 15 respectively. At the top of the frame spaced front and rear display panels 16, 17 respectively are attached to and depend downwardly from the upper frame border 12 and are received between the flanges of an 'H'-section bar 18 extending through the frame and between its end borders 14, 15. Similarly, at the bottom of the frame, spaced front and rear display panels 19, 20 respectively are attached to and extend upwardly from the lower frame border 13 and are received between the flanges of a further 'H'-section bar 21 extending through the frame and between its end borders 14, 15.

The front and rear surfaces of the display sign between the bar 18, 21 both comprise a series of display areas assembled from a number of similar components and, for ease of understanding, reference is now made to the display areas 22, 23, 24 and 25 provided at the front of the display sign.

Each of the front display areas includes a support surface 26 which is an integral part of a substantially channel-shaped element 27 of which the support face is constituted by the web interconnecting a pair of spaced legs 28, 29 of the channel element. The support surface 26 extends beyond each leg so that the legs are spaced inwardly from the edges 30, 31 of the surface 26 and extend towards the rear series of display areas. Adjacent channel elements 27 are interconnected by a generally T-shaped component 32 having a double-leged stem 33, 34 and which is mounted such that the stem of the T is inserted in the space 35 between adjacent channel elements 27 and extends toward the rear series of display areas with the web 36 of the T covering the space between adjacent support surfaces 26.

Hence, the series of front display areas is provided by alternate channel elements 27 and T-shaped components 32.

Figure 2:
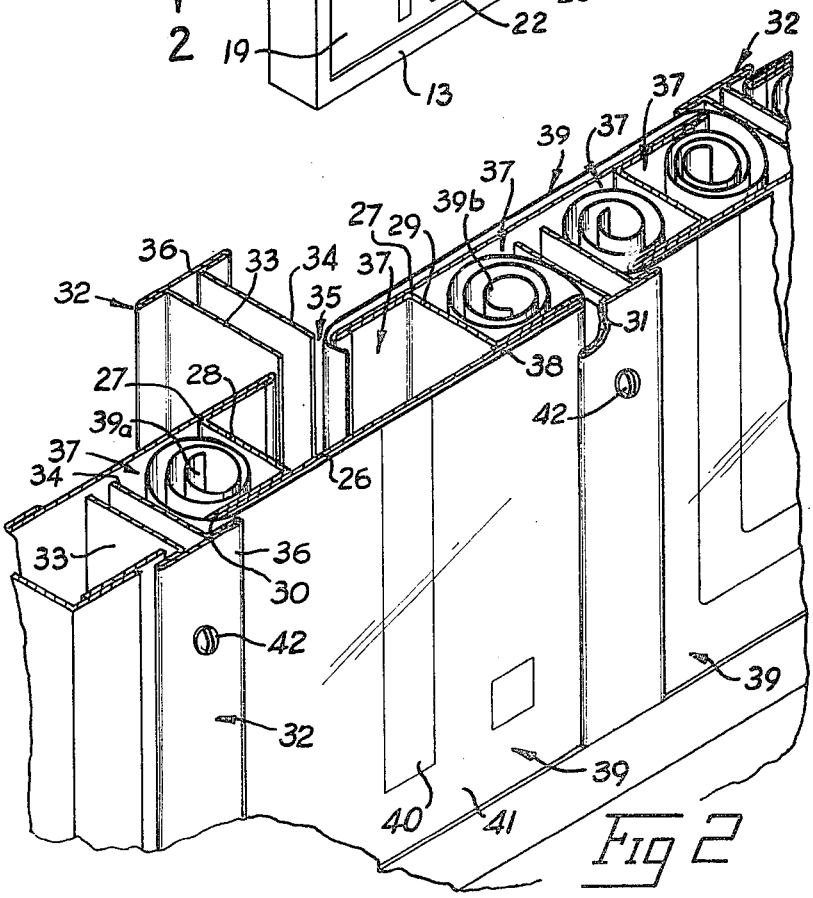
FIG. 2 is an isometric view showing constructional details of the sign.
Figure 3:
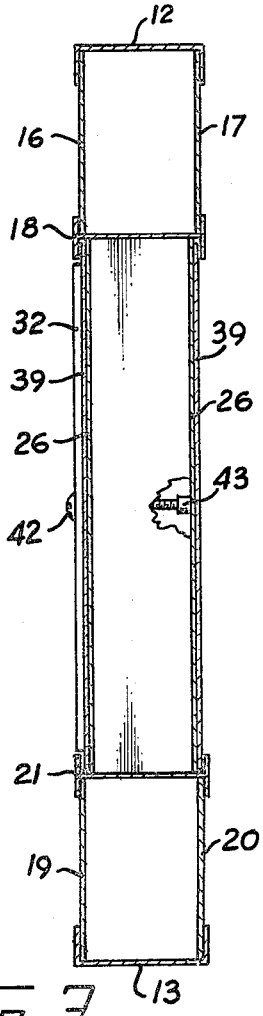
FIG. 3 is a cross-sectional end view of the sign depicted in FIG. 1.

In a similar manner the rear series of display areas (not shown) is also provided by an assembly of alternate channel elements 27 and T-shaped components 32 as illustrated in FIG. 2 which are mounted in the frame so that the rear series of display areas are parallel to but out of registry with the front series of display areas. Hence, the stem 33, 34 of the T components 32 of the front series of display areas are disposed intermediate the legs 28, 29 of the channel elements 27 of the rear series of display elements.

As will be seen by reference to FIG. 2, when the channel elements and T components of the front and rear display areas are assembled in the frame, the support surface 26 of each channel element 27 in one series of display areas is located opposite a T-shaped component 33 in the other series of display areas.

Hence, the opposed channel elements 27 and T-shaped components 33 are staggered whereby the front series of display areas are out of registry with the rear series of display areas. This construction is compact and as shown in FIG. 2 forms a series of cavities 37. Each cavity 37 is provided between the double stem 33, 34 of each T-shaped component and an adjacent leg 28 or 29 of a channel shaped element 27. The purpose of such cavities is explained hereinafter.

The outwardly directed support surface 26 of each channel shaped element 27 is provided with a light-reflective surface 38 and this surface may either cover the whole visible area of the support surface 26 or may be present only in a number of selected areas. Preferably the reflective material is multi-layer retro-reflective laminate such as a relieved or textured MYLAR (Registered Trade Mark) film layer sandwiches between two transparent mylar film layers and backed up by an adhesive layer rendered opaque by addition of titanium dioxide pigments. However, a number of other materials may be utilised such as reflective hot stamp tape disclosed in U.S. Pat. No. 3,949,139 (Dunning, et al.) or a high brilliance reflex reflecting sheet material utilising small glass beads of spheres as disclosed in U.S. Pat. No. 3,190,178 (McKenzie) or a retro-reflective sheet material as disclosed in U.S. Pat. No. 4,075,049 (Wood). The composite light reflective adhesive label disclosed in U.S. Pat. No. 3,936,567 (Vesely) or the composite retro-reflective material comprising a minute corner cube construction as disclosed in U.S. Pat. No. 3,684,348 (Roland) would also be suitable materials.

It is envisaged that the support surface 26 itself is reflective or that any suitable reflective surface may be utilised, e.g. a simple mirrored surface, a highly polished metal surface, aluminium foil or metalised film. However, in the preferred embodiment the reflective surface is provided by a separate element adhered to or otherwise secured on to the support surface.

A strip 39 of self coiling material extends across the support surface 26 so as to have a flat portion which overlies the reflective covering in the display area. Such a self coiling strip is known in the art e.g. the heat treated polyethelene terephtalate disclosed in U.S. Pat. No. 3,426,115 (Taber) which is a material having the tendency to form coils at opposite ends when unrestrained. One such material is sold under the registered trademark 'Spring-Roll'. The opposite coiled ends 39*a*, 39*b* of the strip 39 are located in respective ones of two adjacent cavities 37. It is envisaged that the strip 39 could be provided by a continuous belt or by a tape rolled on to a pair of spools. The strip 39 carries a series of indicia or other information generally referred to as characters 40 presented on adjacent areas 41 and is mounted so as to be slideable with respect to the support surface 26 whereby one or more of the characters can be sequentially presented in the display area simply by applying finger pressure to the flat portion of the strip which is exposed in the display area.

The flange 36 of each T-shaped component 32 overlaps neighbouring strips 39 in adjacent display areas at the side edges 30, 31 of the respective support surfaces 26 so that the portion of each strip intermediate its coiled ends is held in substantially flat condition against its associated support surface 26. Each T-shaped component 32 is screw-threadedly mounted by means of a screw 42 and bush 43 so that it can be adjusted towards and away from the strip. When the flange 36 of the T-shaped component is moved away from the strip, the strip is free to slide with respect to its associated support surface and when the flange is moved into abutment with the strip, the strip is held locked against its associated support surface so as to prevent inadvertent adjustment.

In order that the light impinging on the reflective surface 38 is transmitted outward through the flat portion of the strip present in the display area it is necessary to utilise a strip which has either translucent characters bounded by an area adjacent the character which is opaque or alternatively the characters may be translucent and bounded by a surrounding area which is opaque. Hence, reflected light is transmitted through the translucent part of the strip present in the display area.

In the preferred embodiment, to ensure that the strip slides across the support surface easily, is envisaged that the reflective surface or the rear face of the strip 39 may include a layer or covering of material having a low coefficient of friction. The layer may be formed by a silicon spray. However, where the support surface itself is the reflective material the support surface comprises a material having a low coefficient of friction. It also is envisaged that the side edges 30, 31 of the support surface 26 may be rounded to enhance the sliding motion.

The rear display areas of the sign are constructed in a similar manner and because the front display areas are out of register with the rear display areas it will be appreciated that a compact construction is provided in which neighbouring coiled ends of adjacent strips in one series of display areas are located between the opposite coiled ends of a strip in the other series of display areas. The nature of the compact construction is shown in FIG. 2 in which neighbouring coiled ends are separated from one another merely by a leg 28 or 29 of a channel element or by the stem of a T-component 32. In this manner and by virtue of the staggered formation of the coiled strips maximum utilisation is made of the space available between the front and rear display areas.

It is also envisaged that the sign may be internally illuminated and in such constructions it is preferable to provide a support surface which is at least partially translucent. In this event it is necessary merely to provide one or more sources of internal illumination located between the front and rear series of display areas so that light is transmitted through the translucent portions of the strips. The reflective material may be removed or retained. However, in the preferred embodiment the sign does not include a source of internal illumination.

We claim:

1. A display device comprising a series of at least two support surfaces, each support surface defining at least in part, a display area, and including an adjustable information bearing self-coiling tape having coiled portions at its opposite ends mounted for movement relative to said support surface, said strip having thereon a series of areas defined by characters and a series of areas adjacent the characters, wherein one of said series of areas is translucent, said strip being mounted for slideable movement relative to the support surface so that said characters can be sequentially presented in the display area, and a light reflective surface disposed behind the strip in the display area whereby light impinging on said reflective surface is transmitted through the translucent area of the strip present in the display area and wherein said support surfaces together with their respective information strips are arranged in side by side relationship, adjacent support surfaces being interconnected by a spacer means including a strip retaining flange, said flange being disposed in overlapping relationship with respect to adjacent strips at edge portions of their respective support faces, said spacer means including adjusting means for moving said retaining flange towards and away from the strip whereby the strip can be held locked against its associated reflective surface and released for sliding movement with respect to its associated reflective surface.

2. A display device according to claim 1 wherein a series of at least two support surfaces together with their respective information strips are arranged in side by side relationship, adjacent support surfaces being interconnected by a spacer means including a strip retaining flange said flange being disposed in overlapping relationship with respect to adjacent strips at edge portions of their respective support faces, said spacer means including adjusting means for moving said retaining flange towards and away from the strip whereby the strip can be held locked against its associated reflective surface and released for sliding movement with respect to its associated reflective surface.

3. A device according to claim 1 wherein a further series of support surfaces together with their respective information strips and interconnecting spacer elements is mounted substantially parallel to and spaced from the first mentioned series with the display areas of the respective series facing in opposite directions, both said series being mounted in a surrounding frame and wherein the support surfaces of the one series are out of register with the support surfaces of the other series whereby the neighbouring coiled ends of adjacent strips in one series are located between the opposite coiled ends of a strip in the other series.

4. A display device according to claim 3 wherein said spacer means each comprise a generally T-shaped component and wherein each support surface is provided by a substantially channel shaped element in which the support surface is constituted by the web interconnecting the legs of the channel, the web extending in opposite directions beyond each leg so that the legs are spaced inwardly from the edges of the web and wherein the coiled ends of each strip are accommodated within a cavity provided between one leg of a channel element and the stem of the adjacent T-shaped component.

5. A display device comprising a series of support surfaces each defining at least in part a display area and being connected to an adjacent support surface by a spacer element, an adjustable information strip mounted for slideable movement relative to the support surface in each display area, each of said strips comprising a series of areas defined by characters and a series of areas adjacent the characters, wherein one of said series of areas is translucent, and each of said information strips having a coiled portion at its opposite ends and wherein a further series of support surfaces together with their respective information strips and interconnecting spacer elements is mounted substantially parallel to and spaced from the first mentioned series with the display areas of the respective series facing in opposite directions, the support surfaces of one series being out of register with the support surfaces of the other series whereby neighbouring coiled ends of adjacent strips in one series are located between the opposite coiled ends of a strip in the other series.

6. A display according to claim 1 in which the characters are translucent and the areas adjacent the characters are opaque.

7. A display device according to claim 6 in which the characters are opaque and the areas adjacent the characters are translucent.

8. A display device according to claim 6 in which the strip is a self-coiling tape.

9. A display device according to claim 1 in which each support surface is substantially flat and wherein the side edges of each support surface are rounded to enhance the sliding motion of the strip with respect to the support surface.

10. A display device according to claim 7 in which a material having a low coefficient of friction is interposed between each support surface and its associated strip.

11. A display device according to claim 7 wherein each spacer means includes a strip retaining flange said flange being disposed in overlapping relationship with respect to adjacent strips at edge portions of their respective support faces said spacer means including adjusting means for moving said retaining flange towards and away from the strip whereby the strip can be held locked against its associated suport surface and released for sliding movement with respect to its associated support surface.

12. A display device according to claim 1 in which said spacer means each comprise a generally T-shaped component and wherein each support surface is provided by a substantially channel shaped element in which the support surface is constituted by the web interconnecting the legs of the channel, the web extending in opposite directions beyond each leg so that the legs are spaced inwardly from the edges of the web and wherein the coiled ends of each strip are accommodated within a cavity provided between one leg of a channel element and the stem of the adjacent T-shaped component.

13. A display device according to claim 2 in which a source of illumination is provided between the series of display areas so that light is transmitted through the translucent areas of the strip.

14. A display device according to claim 5 wherein a light reflective surface is disposed behind the strip in each display area whereby light impinging on said reflective surface is transmitted through the translucent area of the strip present in said display area.

* * * * *